US005607015A

United States Patent [19]

Bergren et al.

[11] Patent Number: 5,607,015

[45] Date of Patent: Mar. 4, 1997

[54] METHOD AND APPARATUS FOR INSTALLING ACOUSTIC SENSORS IN A WELLBORE

[75] Inventors: Frank E. Bergren, Anchorage; Curtis G. Blount, Wasilla, both of Ak.; Robert J. Withers, Plano, Tex.; Andrew J. Bond, Anchorage, Ak.

[73] Assignee: Atlantic Richfield Company, Los Angeles, Calif.

[21] Appl. No.: 504,875

[22] Filed: Jul. 20, 1995

[51] Int. Cl.[6] ..... E21B 47/01; E21B 19/02

[52] U.S. Cl. ..... 166/250.01; 166/66; 166/77.1; 166/385

[58] Field of Search ..... 166/250.01, 250.11, 166/385, 77.1, 65.1, 66; 367/25, 57, 81

[56] References Cited

U.S. PATENT DOCUMENTS

| | | | |
|---|---|---|---|
| 2,989,135 | 6/1961 | Pierce, Jr. et al. | 367/57 |
| 4,442,903 | 4/1984 | Schutt et al. | 166/385 |
| 4,572,299 | 2/1986 | Vanegmond et al. | 166/385 |
| 4,585,066 | 4/1986 | Moore et al. | 166/385 |
| 4,592,421 | 6/1986 | Hoffmann et al. | 166/66 |
| 4,681,169 | 7/1987 | Brookbank, II | 166/385 |
| 5,128,898 | 7/1992 | Hill et al. | 367/25 X |
| 5,180,014 | 1/1993 | Cox | 166/385 X |
| 5,503,225 | 4/1996 | Withers | 166/250.1 |

*Primary Examiner*—Hoang C. Dang
*Attorney, Agent, or Firm*—Drude Faulconer

[57] ABSTRACT

A method and apparatus for installing an array of sensors in a wellbore wherein the sensors are incorporated into the lower end of a transmission cable which, in turn, is used to lower the array into the wellbore. A load-bearing cable is simultaneously run into the wellbore side-by-side with the transmission cable and the two cables are clamped together at spaced intervals whereby a substantial portion of the tensile forces in the transmission cable is transferred to the load-bearing cable.

9 Claims, 3 Drawing Sheets

METHOD AND APPARATUS FOR INSTALLING ACOUSTIC SENSORS IN A WELLBORE

DESCRIPTION

1. Technical Field

The present invention relates to a method and apparatus for installing an array of sensors in a wellbore and in one of its aspects relates to a method and apparatus for installing an array of acoustic-energy sensors which are coupled into and are suspended on a transmission cable without subjecting the cable to undue tensile forces by connecting the transmission cable to a separate, load bearing cable at spaced intervals.

2. Background Art

Recently, the "hydraulic fracturing" of subterranean formations has become an important tool in the disposing of unwanted waste materials into subterranean formations. That is, certain waste materials, e.g. drill cuttings or the like from well drilling operations, may be disposed of by forming a slurry which is then injected in certain earth formations; e.g. see U.S. Pat. Nos. 4,942,929 and 5,387,737. The waste slurry may act as a fracturing fluid to form a fracture in the formation where the solid wastes from the slurry are deposited.

One important consideration in disposing of wastes in this manner, especially if the wastes include any hazardous material, is the ecological effect that the disposed material may have on the environment. That is, the wastes, once deposited in a formation, should not leach or migrate out of that formation into another formation, e.g. an aquifier, from which fluids, e.g. water, may be later produced to the surface. Therefore, the formations which are to be used as disposal zones need to be carefully selected.

To insure that a selected disposal zone will properly contain the wastes during and after injection, it is highly beneficial to continuously monitored any hydraulic fracture(s) as it is being formed to prevent the fracture from extending (a) beyond the disposal zone into the surrounding formations or (b) into a fault within the zone whereby the waste material might flow from the fracture and through the fault into the surrounding formations. In fact, it is reasonable to assume that such monitoring may be required by governmental agencies in the near future as more subterranean formations are used as waste disposal zones.

Until recently, the monitoring of a hydraulic fracture(s) (i.e. fracture length, height, width, and rate of growth) at any specific time during a fracturing operation had to be predicted from calculations using complex mathematical models which, in turn, were compiled from a set of predetermined, pre-fracture characteristics of the formation to be fractured. Due to practical considerations (e.g. most subterranean formations are heterogeneous) and the accuracy of the data used, the real-time location of a fracture may vary substantially from the position predicted by a particular model.

Recently, several techniques or systems have been proposed for the real-time monitoring of a fracture as it is being formed in a formation. These systems use arrays of acoustical-energy sensors (e.g. geophones, hydrophones, etc.) which are located in a well (s) that is in acoustical communication with the disposal zone to detect the sequence of seismic events (e.g. shocks or "mini-earthquakes") which occur as the disposal zone is being hydraulically fractured. The sensors convert this acoustic-energy to signals which, in turn, are transmitted to the surface for processing to thereby develop the profile of the fracture(s) as it is being formed in the disposal zone. For examples of such techniques, see (a) "Active and Passive Imaging of Hydraulic Fractures", by P. B. Willis, GEOPHYSICS: The Leading Edge of Exploration, July, 1992; (b) "The Application of High Frequency Seismic Monitoring Methods for the Mapping of Grout Injections" by E. L. Majer, THE INTERNATIONAL JOURNAL OF ROCK MECHANICS, MINING SCIENCE AND GEOMECHANICS, Vol. 26, Nos. 3 and 4, pps. 249–256, 1989; and (c) co-pending, commonly-assigned U.S. patent application Ser. No. 08/196,621, filed Feb. 14, 1995.

In such systems, the sensor arrays may be positioned within either the well used for injecting the fracturing fluid (i.e. injection well) and/or in separate, spaced monitor wells (see copending and commonly-assigned U.S. patent application Ser. No. 08/196,621filed Feb. 14, 1994) or they may be placed within the well annulus of the injection or monitoring well (see co-pending and commonly assigned U.S. patent applications Ser. Nos. 08/426,306, filed Apr. 21, 1995, now U.S. Pat. No. 5,503,225, issued Apr. 2, 1996 and 08/435,015, filed May 5, 1995, now U.S. Pat. No. 5,524,709, issued Jun. 11, 1996.

Once a sensor array is positioned in a well, it is necessary to establish a good acoustical path between the sensors and the subterranean formation (i.e. disposal zone) to be fractured. For example, the sensor array may be attached to and lowered with a string of tubing whereby the weight of the tubing causes the array to contact the casing or the well annulus around the array can be filled with cement after the array is in position. However, using tubing to install the array requires the use of a drilling rig or the like which adds significantly to the installation costs (e.g. may run as high as an additional 0.5 to 1 million dollars per installation).

Where the sensor array is directly coupled into and is lowered on the same cable which is to be used for transmitting signals from the sensors to the surface (i.e. transmission cable), the weight of the array will normally require that the transmission cable include an additional load-bearing element (i.e. wire rope or the like) throughout its length to prevent the tensile forces developed in the cable from damaging or destroying the cable as the array is being installed. Such a specially-constructed transmission cable would significantly increase the deployment costs and manufacturing time for a typical array.

SUMMARY OF THE INVENTION

The present invention provides a method and apparatus for installing an array of sensors in a wellbore wherein the sensors are incorporated into the lower end of a transmission cable which is required to communicate with the array once disposed within the wellbore. A load-bearing cable is simultaneously run into the wellbore side-by-side with the transmission cable and the two cables are clamped together at spaced intervals whereby a substantial portion of the tensile forces in the transmission cable is transferred to and is borne by the load-bearing cable thereby preventing damage to the transmission cable that may otherwise be caused by the tensile forces therein. The present method is useful in installing an array of sensors in any wellbore where such sensors may find application.

More specifically, an array of acoustic-energy sensors (e.g. hydrophones, geophones, accelerometers, tiltmeters, etc.) is physically and electronically coupled into a standard transmission cable which can then be stored on a first reel until it is to be installed by paying out the cable over a first sheave into the wellbore. As the transmission cable is run into the wellbore, a load-bearing cable (e.g. standard perforating cable) is simultaneously fed from a second reel over a second sheave into the wellbore so that it will be run side-by-side with the transmission cable. The cables are connected together at spaced intervals to thereby transfer a substantial portion of the tensile force in the transmission cable to the load-bearing cable.

Preferably, the cables are connected together by split clamps. Each clamp is comprised of two elongated sections which define two axially-extending passages when the sections are aligned with each other for receiving the transmission cable and the load-bearing cable, respectively. The sections of a clamp are held together by metal bands or the like.

When the array has been lowered to its final destination within the wellbore, the upper end of the load-bearing cable is secured to a cable hanger which, in turn, is also made in two symmetrical sections so that it can be assembled around the cables. The transmission cable passes through the hanger while the upper end of the load-bearing cable is secured thereto. The sections of the hanger are secured together and the hanger is then lowered onto a seat in the wellhead structure and may be releasably held in place by bolts of the like or it can be landed in a nipple or the like at the wellhead. The array and cables, if not permanently cemented in the wellbore, are easily removable from the well by merely releasing the bolts and removing hanger from the wellhead structure. Both cables can then be reeled in simultaneously, either onto individual reels as the clamps are removed or as a unit, if desired.

BRIEF DESCRIPTION OF THE DRAWINGS

The actual construction, operation, and apparent advantages of the present invention will be better understood by referring to the drawings which are not necessarily to scale and in Which like numerals identify like parts and in which.

BEST KNOWN MODE FOR CARRYING OUT THE INVENTION

Figure 1:
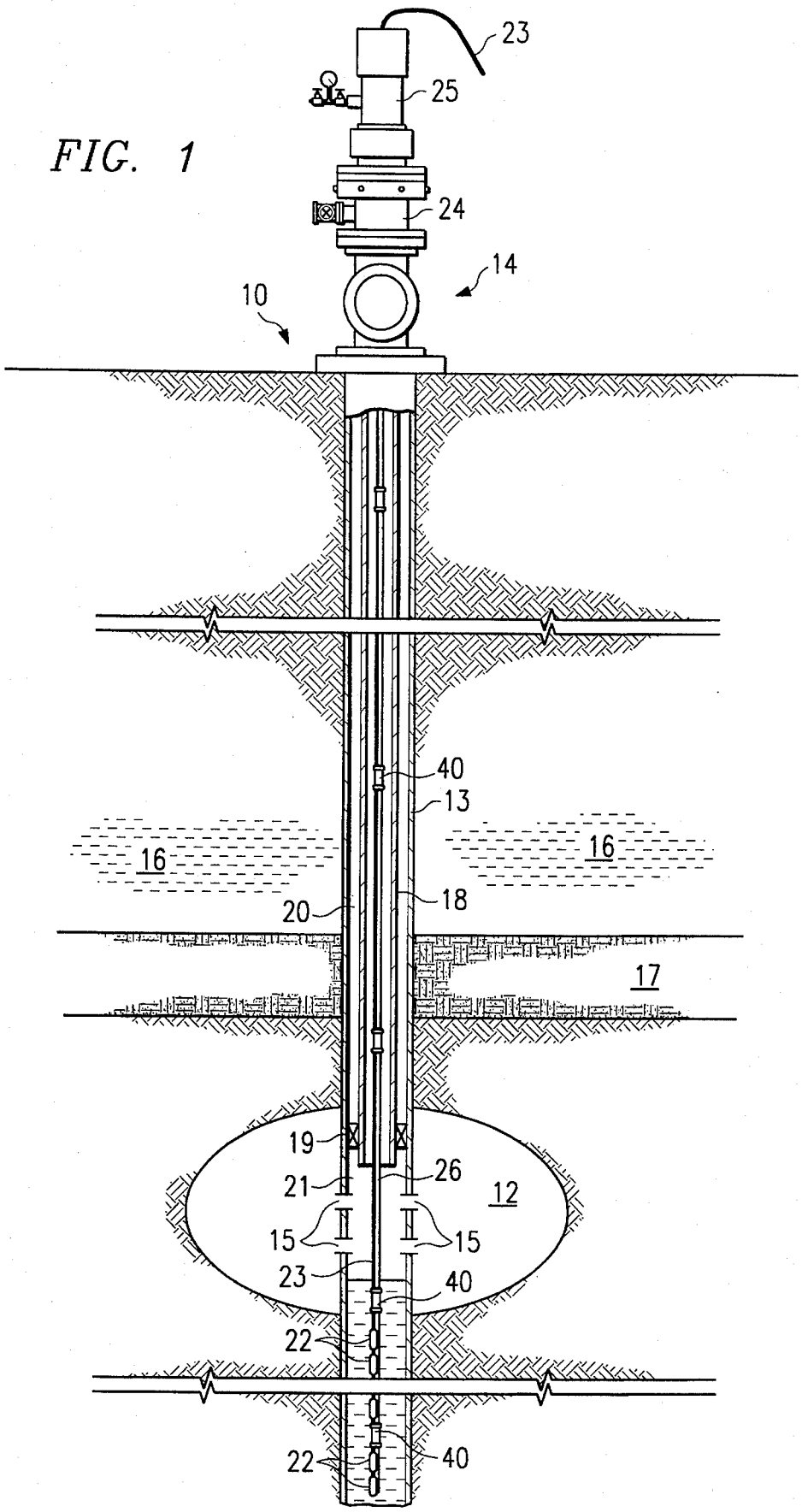
FIG. 1 is an elevational view, partly in section, illustrating a typical injection well for disposing of waste materials into a subterranean formation wherein a sensor array has been installed in accordance with the present invention.

Referring more particularly to the drawings, FIG. 1 discloses a typical well 10 which may be used for disposing of waste material into a subterranean formation 12. While well 10 is illustrated as an injection well (i.e. the well through which the wastes are to be injected), it should be understood that the present invention is equally useful in installing sensor arrays in monitor wells (not shown) which are normally spaced from the injection well or in any other wells when a sensor array may find application.

As shown, injection well 10 has been drilled and completed through a subterranean formation 12 (hereinafter "disposal zone") which, in turn, is to be used in disposing of waste materials (e.g. oily solutions, drill cuttings, etc.). Ideally, disposal zone 12 will lie in a formation which is separated from overlying aquifiers 16 or the like by a layer of a relatively impermeable formation 17 (e.g. shale) which will aid in keeping any hydraulically-induced fractures within zone 12.

Injection well 10 has a well casing 13 which extends from wellhead 14 at the surface through disposal zone 12 and has perforations 15 adjacent the disposal zone. Of course, the actual completion of the well is not critical to the present invention (e.g. casing 13 may be terminated above zone 12 with the rest of the wellbore being completed "open hole" or the like).

A string of tubing 18 is positioned into the wellbore of injection well 10 and terminates near or at perforations 15 in casing 12. Again, it should be understood tubing 18 is not critical to the present invention in that, other than injection wells, a string of tubing may or may not be present when carrying out the present invention. Tubing 18 carries a packer 19 which isolates the injection zone 21 from the well annulus 20 which, in turn, is formed between casing 13 and tubing 18 above packer 19.

In accordance with the present invention, an array of acoustic-energy sensors 22 (e.g. hydrophones, geophones, accelerometers, tiltmeters, etc.) is physically and electronically coupled into a standard transmission cable 23 and is to lowered thereon into a wellbore and is positioned to receive acoustical energy as it is generated by the fracturing of the disposal zone. The intervals at which the sensors will be spaced (e.g. 15–200 feet) will depend on the particular operation being carried out and a particular array may extend for a substantial distance (e.g. thousands of feet) above and/or below perforations 15 when positioned in an injection well. Where the array is to be positioned above the perforations 15 in injection well 10 (array not shown), it is preferably positioned within annulus 20 above packer 19.

In a typical monitor well (not shown), an array having a large number of sensors (40–50 geophones) may have sensors which lie above, through, and below the expected vertical boundaries of the hydraulic fracture which is to be formed in zone 12. Again, the number and spacing of the sensors along the transmission cable and their placement in a well will depend upon the particular application involved and is not critical to the present invention since the actual installation of a sensor array within its respective wellbore in accordance with the present invention will be substantially the same in all applications.

Figure 3:
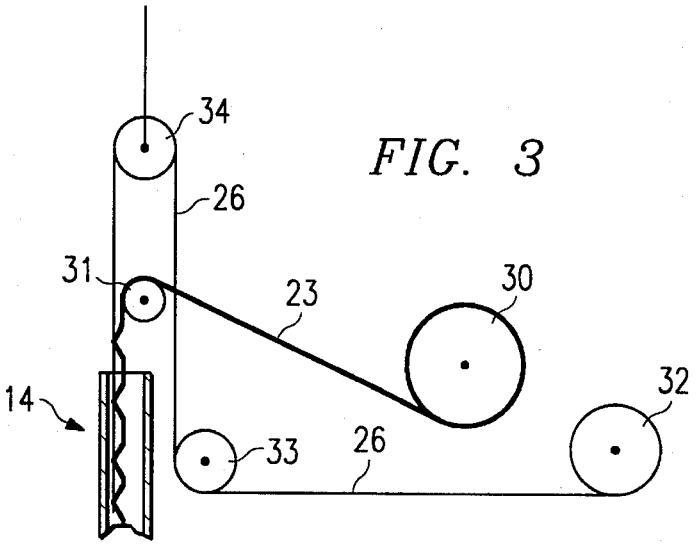
FIG. 3 is a schematical view of the respective cables used in carrying out the present invention as they are being installed in a wellbore.

In carrying out the present invention in a typical well, the array of acoustical-energy sensors 22 (e.g. 26 geophones at 200 feet intervals) is made up into the lower end of transmission cable 23. Preferably, cable 23 is selected from standard transmission cable of the type normally used on the surface in routine seismic operations (e.g. 0.62", integral 170 conductor cable, available from Mercury Cable. Once the array has been assembled into transmission cable 23, the cable can then be reeled onto a first spool 30 (FIG. 3) so that the array is positioned to come off first. Spool 30 is positioned near wellhead 14 and the lower end of transmission line 23 is passed over a sheave 31 which is substantially aligned with well 10 or tubing 18, as the case may be.

Figure 2:
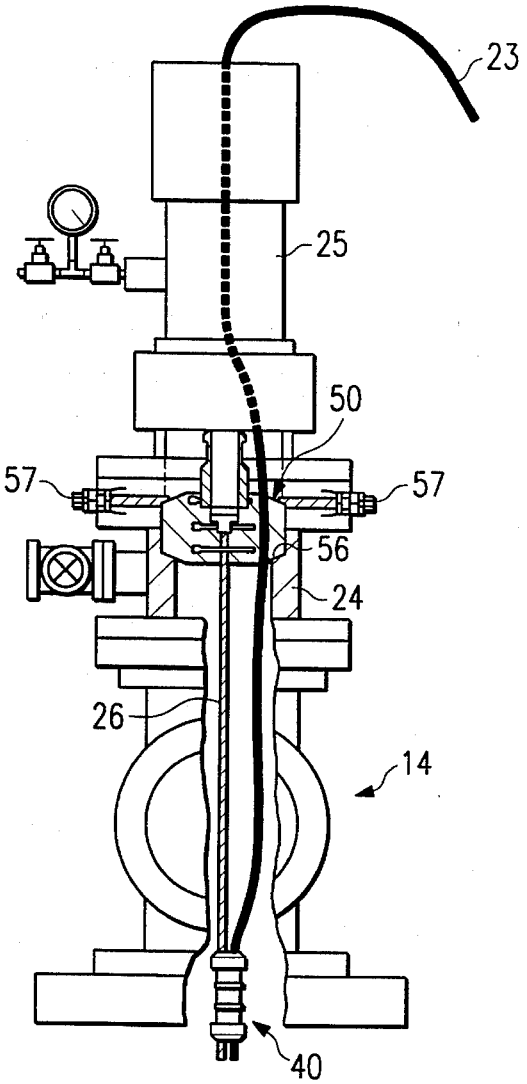
FIG. 2 is an enlarged view of the wellhead structure of FIG. 1, partly in section, further illustrating the present invention.

Wellhead structure 14, as shown in FIG. 2, is positioned on casing 13 and is comprised of housing 24 (e.g. spool piece) and a line wiper assembly 25. Line wipe r assembly 25 may be any of several which are commercially available but preferably is one which can be assembled onto housing 24 before the array is run into the wellbore, e.g. a single cable packoff head such as Hydraulic Line Wiper, Model B, Bowen Tools, Inc., Houston, Tex. which has removable internal elements (i.e. rubber and brass wiper unit) to thereby provide a large open bore therethrough.

As transmission cable 23 with the sensor array is run through wellhead 14 and into the wellbore, a load-bearing cable 26 is simultaneously fed into the wellbore side-by-side with transmission cable 23. Load-bearing cable 26 may be selected from any cable (e.g. wire line) which is capable of withstanding the tensile forces developed in the transmission cable as it and the sensor array is lowered to its ultimate position within the well. However, preferably load-bearing cable 26 is standard 0.32" cable which is commonly used to run a perforating gun or the like into a wellbore and is easily deployable from a small mobile winch unit (e.g. "e-line" perforating units, Schlumberger Well Services, Houston, Tex.). In a typical such unit, cable 26 is stored on reel 32 (FIG. 3) and is ran over sheaves or pulleys 33, 34.

Figure 4:
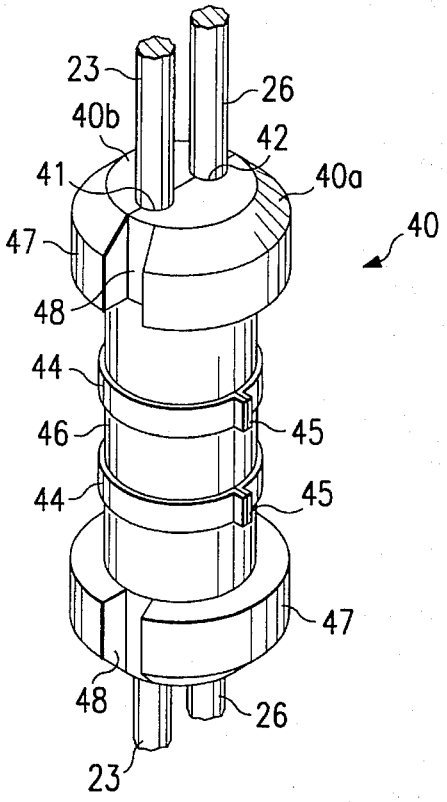
FIG. 4 is an enlarged perspective view of a clamp which may be used to secure the two cables of the present invention together at spaced intervals along their lengths.

As the transmission cable 23 and load-bearing cable are payed out simultaneously, they are connected together at spaced intervals (e.g. 50 feet) along their lengths. While the cables can be connected or tied together by any appropriate means, preferably a split clamp 40 (e.g. polyurethane) such as shown in FIGS. 2 and 4, is used to secure the two cables together at each of the spaced intervals. Clamp 40 is made in two elongated sections 40*a*, 40*b*, each having two axially-extending, semi-cylindrical recesses therein which, when aligned, form cylindrical passages 41, 42, which in turn, are adapted to receive transmission cable 23 and load-bearing cable 26, respectively.

The sections of clamp 40 are fitted about the respective cables at each selected interval and are secured in place by one or more bands 44 (two shown in FIG. 4) or the like which fits into the recessed body 46 of the clamp. The ends of each band 44 (e.g. ⅝ inch, stainless steel "BAND-IT" material, Idex Corp., Denver, Colo.) may be secured by any appropriate means 45 (e.g. bend back and rolldown lock buckle, etc.). Further, if the outside diameter of the end portions 47 of clamp 40 approaches the inside diameter of the well conduit into which the clamped cables are to be lowered, each clamp 40 may also include axially-aligned slots 48 (only one set shown in FIG. 4) through the end portions 47 to allow well fluids to by-pass the clamps.

By so connecting the two cables together at spaced intervals, a substantial portion of the tensile force in the transmission cable 23 is transferred to and is borne by the load-bearing cable thereby protecting the transmission cable 23 from damage due to excessive tensile force (i.e. weight of the array and cable).

Figure 5:
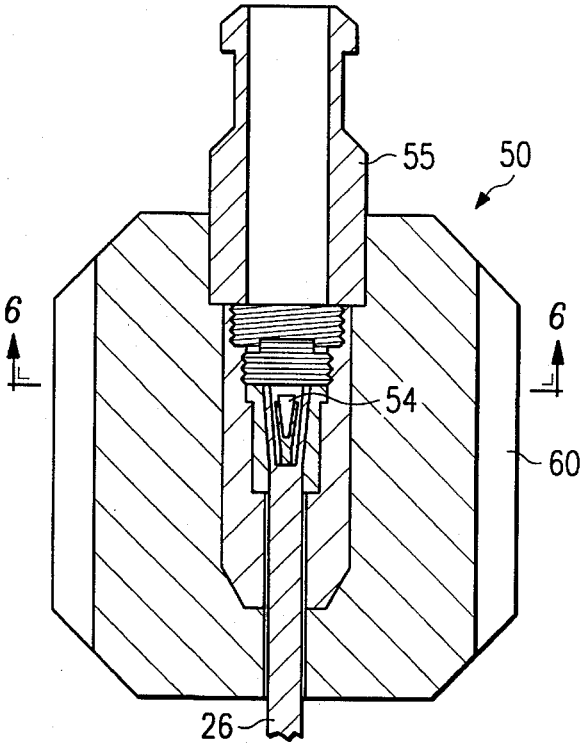
FIG. 5 is an enlarged sectional view of the cable hanger structure of FIG. 1.
Figure 6:
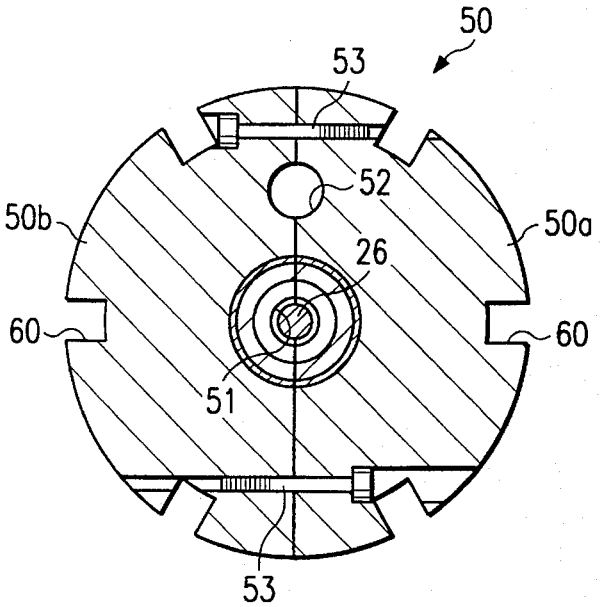
FIG. 6 is a sectional view of the cable hanger structure taken along line 6—6 of FIG. 5.

As the array approaches its final destination within the wellbore, the upper end of load-bearing cable 26 is secured to cable hanger 50 (FIGS. 2, 5, and 6). As shown, hanger 50 is made in two substantially, symmetrically sections 50*a*, 50*b*, each having two axially-extending, semi-cylindrical recesses which when aligned will form passages 51, 52, which, in turn, are adapted to receive load-bearing cable 26 and transmission cable 23, respectively. The sections of hanger 50 are positioned around the cables and are secured together by bolts 53 or the like.

Transmission cable 23 extends on through hanger 50 so that its upper end can be connected to a receiver (not shown) or the like for receiving and/or processing the signals from the sensor array. Load-bearing cable 26 is terminated and its upper end is secured to hanger 50 by any appropriate means (e.g. a cone-and-basket wedge fitting 54). A fishing neck 55 is threaded or otherwise attached to hanger to aid in lifting and lowering same. Also, hanger 50 has a plurality of longitudinal flow passages 60 spaced around its periphery to allow fluids to bypass same.

Once load-bearing cable 26 has been secured to hanger 50, the hanger is lowered through the open bore of line wiper assembly 25 onto seat 56 in housing 24 (FIG. 2) and can be held in place by bolts 57 or the like. If the wiper elements (not shown) have been removed, they are then replaced into line wiper assembly 25 and the appropriate fluids or cement can then be flowed into the wellbore to acoustically couple the sensors of the array to the wellbore, hence the formation to be monitored. Of course, if the outside diameter of hanger 50 is larger than the inside diameter of the bore through wiper assembly 25, then the wiper assembly can be removed and then replaced after the hanger has been seated in the housing.

Figure 2A:
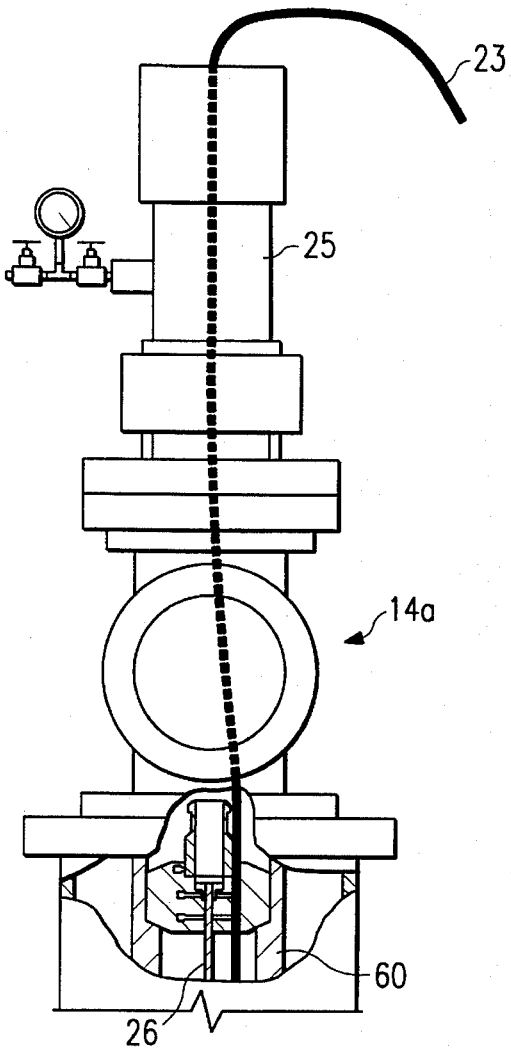
FIG. 2A is an enlarged view of another embodiment of the wellhead structure of FIG. 1, partly in section.

FIG. 2A illustrates a slightly modified wellhead structure 14*a* which eliminates the need for housing 24. A landing nipple 60 (e.g. a back pressure valve nipple) is positioned at the upper end of the conduit into which the sensor array is to be lowered. The sensor array is assembled and hanger 50*a* is connected to the upper end thereof in the same manner as described above. The array is lowered and hanger 50*a* is landed on the shoulder of nipple 60 and is releasably secured thereon by the weight of the array or by screws or the like (not shown) similarly as disclosed above. The remainder of the wellhead structure, i.e. valves, wiper assembly 25, etc., is basically the same as in FIG. 2.

Where fluids or the like are used to couple the array to the formation, the array, including both cables, can easily removable from the well after the monitoring operation has been completed by merely releasing bolts 57 and picking up and removing hanger 50. Both cables can then be reeled in simultaneously, either individually by removing each of the clamps 40 as they come to the surface, or as a unit, if desired.

By being able to remove the array after a monitoring operation has been completed, the well can then be used for other purposes which may be of significant value in many environments.

What is claimed is:

1. A method for installing an array of sensors in a wellbore which includes a wellhead structure, said method comprising:

assembling an array of sensors into a transmission cable;

running said transmission cable into the wellbore;

running a load-bearing cable into said well simultaneously with said transmission cable;

connecting said transmission cable and said load-bearing cable together at spaced intervals along their lengths whereby a substantial portion of the tensile forces in said transmission cable is transferred to said load-bearing cable;

extending the upper end of said transmission cable through said wellhead structure;

securing the upper end of said load-bearing cable to a cable hanger; and releasably securing said cable hanger in said wellhead structure.

2. The method of claim 1 wherein said sensors are acoustical-energy sensors.

3. A method for installing an array of sensors in a wellbore which includes a wellhead structure, said method comprising:

assembling an array of sensors into a transmission cable;

running said transmission cable from a first reel, over a first sheave, and into the wellbore;

running a load-bearing cable from a second reel, over a second sheave, and into said well simultaneously and side-by-side with said transmission cable;

connecting said transmission cable and said load-bearing cable together at spaced intervals along their lengths whereby a substantial portion of the tensile forces in said transmission cable is transferred to said load-bearing cable;

extending the upper end of said transmission through said wellhead structure;

securing the upper end of said load-bearing cable to a cable hanger;

releasably securing said cable hanger in said wellhead structure.

4. The method of claim 3 wherein said sensors are acoustical-energy sensors.

5. The method of claim 3 wherein said step of connecting said cables together at each of said spaced intervals comprises:

positioning two symmetrical sections of a clamp around said transmission cable and said load-bearing cable to connect said cables to each other; and securing said two sections of said clamp together.

6. Apparatus for installing an array of sensors in a wellbore, said apparatus comprising:

a transmission cable;

an array of sensors coupled into the lower end of said transmission cable;

a load-bearing cable extending side-by-side along a substantial length of said transmission cable;

a plurality of clamps spaced at intervals along the respective lengths of said cables, each of said plurality of clamps, connecting said cables to each other at a respective interval whereby a substantial portion of tensile forces in the transmission cable are transferred and borne by said load-bearing cable; each of said plurality of clamps comprising:

two sections, each having two semi-cylindrical, axially extending recesses which when said sections are assembled form two cylindrical passages for receiving said transmission cable and said load-bearing cable, respectively; and means for securing said sections of said clamps together;

a hanger; and means for connecting the upper end of said load-bearing cable to said hanger.

7. The apparatus of claim 6 wherein said hanger comprising:

two substantially symmetrically sections, each having two semi-cylindrical, axially extending recesses which when said sections are assembled form two cylindrical passages; one of said two passages for passing said transmission cable through said hanger and the other of said two passages for receiving said load-bearing cable; and means for securing said sections of said hanger together.

8. The apparatus of claim 7 including:

wellhead structure mounted at the upper end of the wellbore having a seat therein adapted to receive and support said hanger.

9. The apparatus of claim 8 including:

means for releasable securing said hanger on said seat in said wellhead structure.

* * * * *